US008187346B2

(12) United States Patent
Butler

(10) Patent No.: US 8,187,346 B2
(45) Date of Patent: May 29, 2012

(54) STABILIZATION OF PYGAS FOR STORAGE

(75) Inventor: James R. Butler, League City, TX (US)

(73) Assignee: Fina Technology, Inc., Houston, TX (US)

( * ) Notice: Subject to any disclaimer, the term of this patent is extended or adjusted under 35 U.S.C. 154(b) by 500 days.

(21) Appl. No.: 12/345,567

(22) Filed: Dec. 29, 2008

(65) Prior Publication Data

US 2010/0162617 A1 Jul. 1, 2010

(51) Int. Cl.
*C10L 1/18* (2006.01)
*C07C 50/00* (2006.01)

(52) U.S. Cl. ..... 44/437; 568/329

(58) Field of Classification Search ..... 44/437; 568/329

See application file for complete search history.

(56) References Cited

U.S. PATENT DOCUMENTS

| | | | | |
|---|---|---|---|---|
| 1,834,679 | A | 12/1931 | Canon et al. | |
| 5,509,944 | A | 4/1996 | Venkatadri et al. | |
| 5,616,774 | A | 4/1997 | Evans et al. | |
| 5,711,767 | A | 1/1998 | Gande et al. | |
| 5,750,765 | A | 5/1998 | Nesvadba et al. | |
| 6,926,820 | B2 * | 8/2005 | Eldin et al. | 208/48 AA |
| 6,949,686 | B2 | 9/2005 | Kaminsky | |
| 6,960,279 | B2 | 11/2005 | Merrill | |
| 2003/0225305 | A1 | 12/2003 | Kaminsky | |
| 2004/0055932 | A1 | 3/2004 | Eldin et al. | |
| 2005/0032941 | A1 | 2/2005 | Hart et al. | |
| 2006/0020089 | A1 | 1/2006 | Merrill | |
| 2006/0155140 | A1 | 7/2006 | Benage | |

* cited by examiner

*Primary Examiner* — Cephia D Toomer
*Assistant Examiner* — Pamela H Weiss

(57) ABSTRACT

A method for stabilizing pyrolysis gasoline in storage involves adding an effective amount of a quinone methide compound to the pyrolysis gasoline. The quinone methide does not require oxygen for activity. Embodiments of the quinone methide do not contain nitrogen and will have a reduced tendency for ammonia production.

14 Claims, 2 Drawing Sheets

STABILIZATION OF PYGAS FOR STORAGE

CROSS-REFERENCE TO RELATED APPLICATIONS

Not applicable.

FIELD

The present invention generally relates to the storage and stabilization of pyrolysis gasoline.

BACKGROUND

Pyrolysis gasoline (pygas) is a liquid by-product of ethylene production, formed by the steam cracking of crude oil fractions such as naphtha. Pygas generally consists of heavy ($C_5$ to $C_{14}$) saturated and unsaturated hydrocarbons; its unsaturated hydrocarbons include olefins, dienes, and aromatics. Pygas can be used as a gasoline blending stream; pygas is generally high octane and within the general gasoline boiling range of from about 100° to about 435° F. Pygas can also be the source of aromatics for petrochemical processes. For instance, BTX extraction yields the compounds benzene, toluene, and xylene.

Pygas can be subject to destabilization by the polymerization of its reactive olefins and dienes. A common practice at steam crackers is to stabilize pygas with phenylenediamine or other similar anti-oxidant in storage. A drawback to phenylenediamine is that it requires air to be active for stabilization. In addition, phenylenediamine can be converted to ammonia in the pygas treater section. This can lead to ammonia excursions in the treated product.

In view of the above it would be desirable to utilize a compound for the storage of pygas that neither requires oxygen nor produces ammonia.

SUMMARY

Embodiments of the present invention generally include a method for stabilizing pygas in storage by adding to pygas an amount of a quinone methide compound. Quinone methide does not require oxygen for activity and is not prone to produce ammonia.

In one embodiment, the quinone methide is of the formula

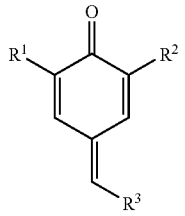

wherein R1, R2, and R3 are independently selected from the group consisting of —H, an alkoxy such as —OMe or —OEth, —$NH_2$, alkyl of 4 to 18 carbon atoms, cycloalkyl of 5 to 12 carbon atoms, phenylalkyl of 7 to 15 carbon atoms, tert-butyl, tert-amyl, tert-octyl, cyclohexyl, alpha-methylbenzyl, and alpha,alpha-dimethylbenzyl substituents.

In another embodiment, the quinone methide is a 7-aryl quinone methide, meaning that the R3 substituent is an aryl group. In one embodiment, the quinone methide is of the formula

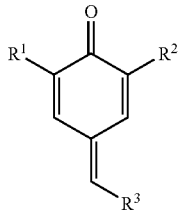

wherein R1 and R2 are independently selected from the group consisting of tert-butyl, tert-amyl, tert-octyl, cyclohexyl, alpha-methylbenzyl, and alpha,alpha-dimethylbenzyl substituents, and R3 is an aryl group.

In another embodiment, the quinone methide is any compound according to either of the two preceding paragraphs, wherein R1, R2, and R3 contain no nitrogen atoms, and are thus will not produce ammonia.

In another embodiment, the quinone methide is 2,6-di-tert-butyl-4-benzylidene-cyclo-2,5-dienone.

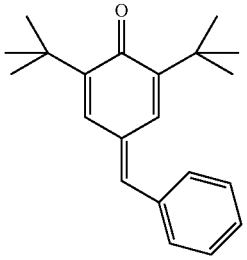

The quinone methide can be added to the pygas downstream of the steam cracker, or at the time of pygas storage. A single quinone methide compound can be used, or a plurality of different quinone methide compounds can be used. The amount of quinone methide added to the pygas can be from 1 ppm to 10,000 ppm, optionally from 10 to 1,000 ppm, or optionally from 50 ppm to 100 ppm.

DETAILED DESCRIPTION

Quinone methides, especially 7-aryl quinone methides, are known for their ability to inhibit polymerization, and have been used in styrene plants to inhibit polymerization of styrene monomer. Quinone methides can be useful for the storage of pygas by inhibiting the polymerization of unsaturated compounds because they do not require oxygen to be active. Certain quinone methides do not contain nitrogen and therefore will have a reduced tendency to form ammonia.

Figure 1:
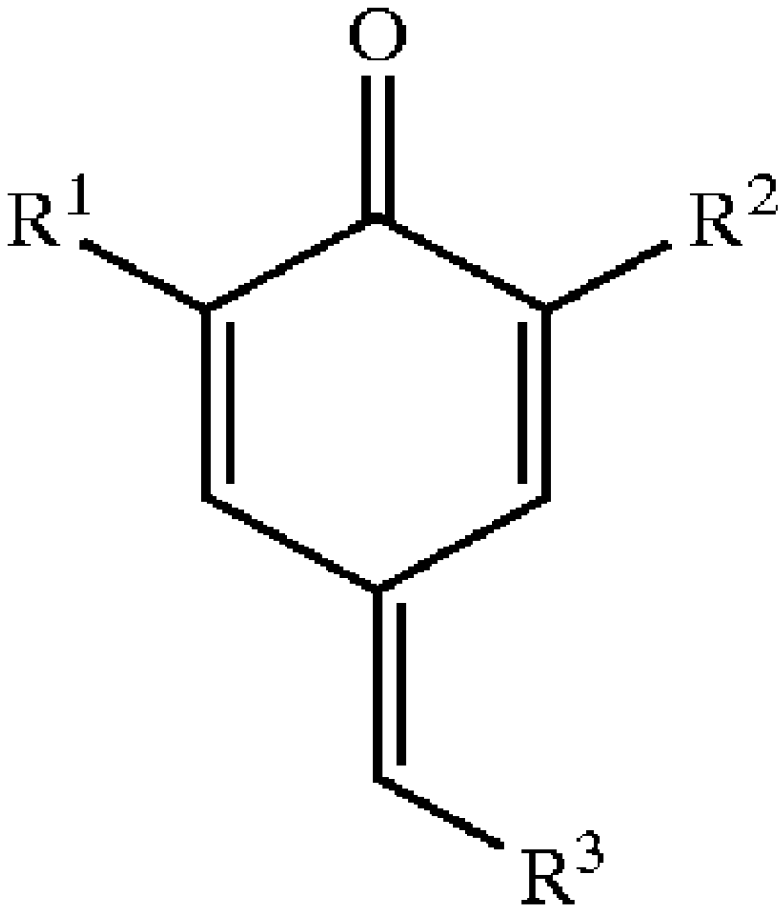
FIG. 1 illustrates a representative structure for a quinone methide.
Figure 2:
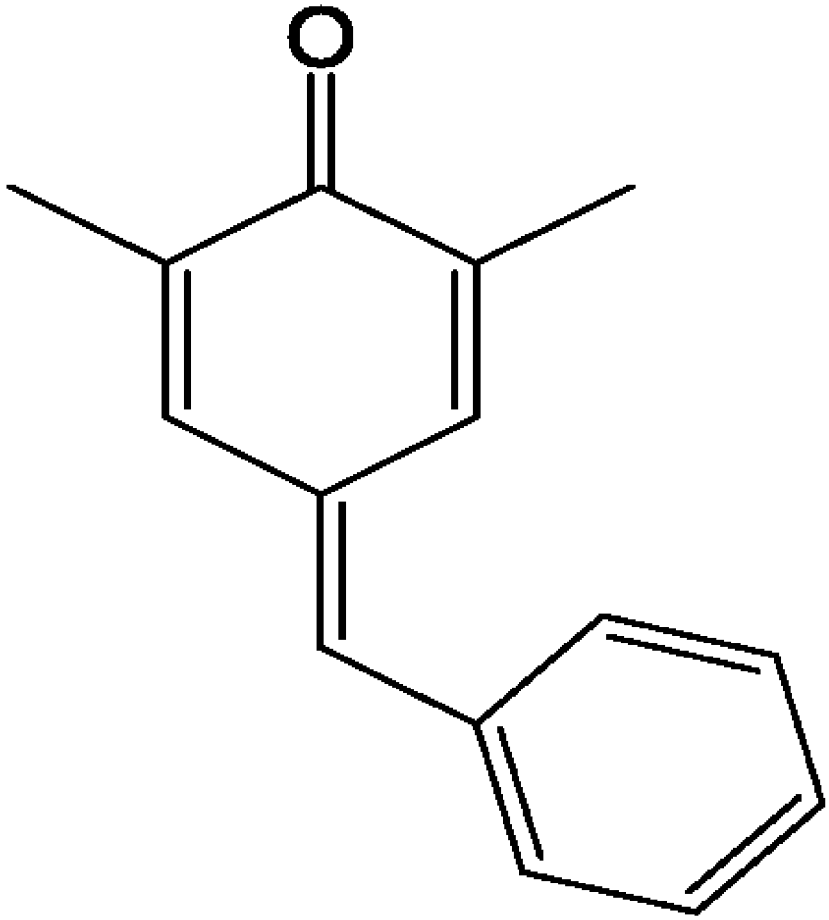
FIG. 2 illustrates a representative example for a quinone methide compound.

Quinone methides are substituted compounds of the representative compound in FIG. 1. The substituents R1, R2, and R3 can be many different groups.

In one embodiment, the substituents R1, R2, and R3 may independently be selected from the group including —H, an alkoxy such as —OMe or —OEth, —$NH_2$, alkyl substituents, cycloalkyl substituents, or phenylalkyl substituents of 7 to 15 carbon atoms. If any of R1, R2, or R3 are alkyl substituents, they may be substituted or unsubstituted, straight or branched chains. Alkyl subsituents can have from 1 to 18 carbon atoms. Examples of unsubstituted alkyl substituents include methyl, ethyl, propyl, isopropyl, n-butyl, t-butyl, isobutyl, pentyl, hexyl, isohexyl, heptyl, 4,4-dimethyl pentyl, octyl, 2,2,4-trimethylpentyl, nonyl, decyl, undecyl, dodecyl, and the like. The alkyl substituents may also be tert-butyl, tert-amyl, tert-octyl, cyclohexyl, alpha-methylbenzyl or alpha,alpha-dimethylbenzyl. If any of R1, R2, or R3 are cycloalkyl substituents, they may be saturated or unsaturated, aromatic or non-aromatic cyclic groups. Cycloalkyl substituents can have from 5 to 12 carbon atoms. Cycloalkyl substituents may include at least one heteroatom (such as N, O, and S) in at least one ring. Examples of heterocyclic groups include, without limitation, 2-, 3- or 4-pyridyl, 2- or 3-thienyl, 2- or 3-pyrryl, 2- or 3-furyl, imidazolyl, pyrrolidinyl, piperidinyl, azepinyl, indolyl, isoindolyl, quinolinyl, isoquinolinyl, benzothiazolyl, benzoxazolyl, benzimidazolyl, benzoxadiazolyl, and benzofurazanyl.

In another embodiment, the quinone methide is 7-aryl, meaning the R3 is an aryl group. 7-aryl quinone methides can be more stable than quinone methides with alkyl or other R3 substituents. In one embodiment R1 and R2 are independently chosen from the group comprising —H, an alkoxy such as —OMe or —OEth, —$NH_2$, alkyl, cycloalkyl, or phenylalkyl of 7 to 15 carbon atoms, while R3 is chosen from the group comprising 2-, 3- or 4-pyridyl, 2- or 3-thienyl, 2- or 3-pyrryl, 2- or 3-furyl, aryl substituents of 6 to 10 carbon atoms. Said aryl substituents can be substituted by one to three of any of the following: alkyl groups of 1 to 8 carbon atoms, alkoxy groups of 1 to 8 carbon atoms, alkylthio groups of 1 to 8 carbon atoms, alkylamino groups of 1 to 8 carbon atoms, dialkylamino groups of 2 to 8 carbon atoms, or alkoxycarbonyl groups of 2 to 8 carbon atoms; or hydroxy, nitro, amino, cyano, carboxy, aminocarbonyl, methoxy, or chloro groups; or mixtures thereof.

In another embodiment, the quinone methide of the invention is any listed in U.S. Pat. No. 6,960,279 to Merrill, which is herein incorporated by reference.

Specific examples of quinone methides that can be useful in the present invention include 2,6-di-tert-butyl-4-(4-nitrobenzylidene)-cyclohexa-2,5-dienone, 2,6-di-tert-butyl-4-(3-nitrobenzylidene)-cyclohexa-2,5-dienone, 2,6-di-tert-butyl-4-(4-cyano-benzylidene)-cyclohexa-2,5-dienone, 2,6-di-tert-butyl-4-(4-dimethylaminobenzylidene)-cyclohexa-2,5-dienone, 2,6-di-tert-amyl-4-benzylidene-cyclohexa-2,5-dienone, 2,6-di-tert-butyl-4-(4-methoxybenzylidene)-cyclohexa-2,5-dienone, and 2,6-di-tert-butyl-4-(3,5-di-tert-butyl4-hydroxybenzylidene)-cyclohexa-2,5-dienone, and 2,6-di-tert-butyl-4-benzylidene-cyclohexa-2,5-dienone, 4-benzylidene-2,6-di-tert-butyl-cyclohexa-2,5-dienone, and 2,6-di-tert-butyl-4-((3,5-di-tert-butyl-4-hydroxy-benzylidene)-cyclohexa-2,5-dienone.

In yet another embodiment, the quinone methide is any compound according to any of the preceding five paragraphs, excluding those compounds that contain nitrogen atoms, as these compounds may potentially be able to produce ammonia. Substituent groups such as amino, nitro, cyano, pyridyl, pyrryl, imadizolyl, pyrrolidinyl, piperidinyl, azepinyl, indolyl, isoindolyl, and any others that include nitrogen are excluded in this embodiment.

Many chemical compounds of the basic structure in FIG. 1 are available to use in the present invention, for the stabilization of pygas in storage. The quinone methide of choice may be added at several different stages in the processing of pygas, downstream of the steam cracker, or at the time of pygas storage. A single quinone methide compound can be used, or a plurality of different quinone methide compounds can be used. The amount of quinone methide added to the pygas can be from 1 ppm to 10,000 ppm, optionally from 10 ppm to 1,000 ppm, or optionally from 50 ppm to 100 ppm. The conditions of storage of pygas are not limiting within the present invention and can be at any pressure or temperature, although the storage is typically at a temperature of less than 200° F.

The term "alkyl" refers to a functional group or side-chain that consists solely of single-bonded carbon and hydrogen atoms, for example a methyl or ethyl group.

The term "aryl" is meant to include optionally substituted homocyclic aromatic groups, which may contain one or two rings and 6 to 12 ring carbons. Examples of such groups include phenyl, biphenyl, and naphthyl.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Other and further embodiments, versions and examples of the invention may be devised without departing from the basic scope thereof and the scope thereof is determined by the claims that follow.

What is claimed is:

1. A method for stabilizing pyrolysis gasoline in storage comprising: the addition of an effective inhibiting amount of quinone methide to said pyrolysis gasoline, the method not requiring the addition of oxygen;

wherein the quinone methide is added to the pyrolysis gasoline during storage of the pyrolysis gasoline.

2. The method of claim 1, wherein the quinone methide is of the formula

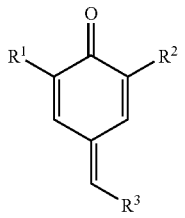

wherein R1, R2, and R3 are independently selected from the group consisting of H, an alkoxy, —$NH_2$, alkyl of 4 to 18 carbon atoms, cycloalkyl of 5 to 12 carbon atoms, phenylalkyl of 7 to 15 carbon atoms, tert-butyl, tert-amyl, tert-octyl, cyclohexyl, alpha-methylbenzyl, and alpha,alpha-dimethylbenzyl.

3. The method of claim 2, wherein R1, R2, and R3 contain no nitrogen atoms.

4. The method of claim 2, wherein R1 and R2 are independently selected from the group consisting of tert-butyl, tert-amyl, tert-octyl, cyclohexyl, alpha-methylbenzyl, and alpha, alpha-dimethylbenzyl, and R3 is an aryl group.

5. The method of claim 4, wherein R1, R2, and R3 contain no nitrogen atoms.

6. The method of claim 1, wherein the quinone methide comprises 2,6-di-tert-butyl-4-benzylidene-cyclo-2,5-dienone.

7. The method of claim 1, wherein the quinone methide is added to the pyrolysis gasoline in the amount of from 1 ppm to 10,000 ppm.

8. The method of claim 1, wherein the quinone methide is added to the pyrolysis gasoline in the amount of from 10 ppm to 1,000 ppm.

9. The method of claim 1, wherein the quinone methide is added to the pyrolysis gasoline in the amount of from 50 ppm to 100 ppm.

10. A method for stabilizing pyrolysis gasoline in storage with reduced ammonia by-product production comprising: the addition of an effective inhibiting amount of quinone methide to pyrolysis gasoline, wherein the quinone methide has the formula

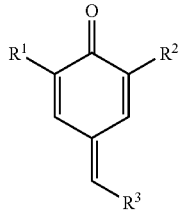

where R1, R2, and R3 are independently selected from the group consisting of H, an alkoxy, alkyl of 4 to 18 carbon atoms, cycloalkyl of 5 to 12 carbon atoms, phenylalkyl of 7 to 15 carbon atoms, tert-butyl, tert-amyl, tert-octyl, cyclohexyl, alpha-methylbenzyl, and alpha,alpha-dimethylbenzyl and R1, R2, and R3 contain no nitrogen atoms; and wherein the quinone methide is added to the pyrolysis gasoline during storage of the pyrolysis gasoline.

11. The method of claim 10, wherein the quinone methide comprises 2,6-di-tert-butyl-4-benzylidene-cyclo-2,5-dienone.

12. The method of claim 10, wherein the quinone methide is added to the pyrolysis gasoline in the amount of from 1 ppm to 10,000 ppm.

13. The method of claim 10, wherein the quinone methide is added to the pyrolysis gasoline in the amount of from 10 ppm to 1,000 ppm.

14. The method of claim 10, wherein the quinone methide is added to the pyrolysis gasoline in the amount of from 50 ppm to 100 ppm.

* * * * *